US009709237B2

(12) United States Patent
Suzuki

(10) Patent No.: US 9,709,237 B2
(45) Date of Patent: Jul. 18, 2017

(54) VEHICLE LAMP

(71) Applicant: ICHIKOH INDUSTRIES, LTD., Isehara-shi, Kanagawa-ken (JP)

(72) Inventor: Yasufumi Suzuki, Isehara (JP)

(73) Assignee: ICHIKOH INDUSTRIES, LTD., Isehara-Shi (JP)

( * ) Notice: Subject to any disclaimer, the term of this patent is extended or adjusted under 35 U.S.C. 154(b) by 0 days.

(21) Appl. No.: 14/782,172

(22) PCT Filed: Apr. 4, 2014

(86) PCT No.: PCT/JP2014/060015
§ 371 (c)(1),
(2) Date: Oct. 2, 2015

(87) PCT Pub. No.: WO2014/163197
PCT Pub. Date: Oct. 9, 2014

(65) Prior Publication Data

US 2016/0047520 A1 Feb. 18, 2016

(30) Foreign Application Priority Data

Apr. 4, 2013 (JP) ..... 2013-078413

(51) Int. Cl.
*F21V 7/00* (2006.01)
*F21S 8/10* (2006.01)

(52) U.S. Cl.
CPC ..... *F21S 48/1721* (2013.01); *F21S 48/1159* (2013.01); *F21S 48/1258* (2013.01); *F21S 48/1317* (2013.01); *F21S 48/1323* (2013.01); *F21S 48/1757* (2013.01)

(58) Field of Classification Search
CPC ..... F21S 48/1159; F21S 48/1258; F21S 48/1317; F21S 48/1757
USPC ..... 362/514
See application file for complete search history.

(56) References Cited

U.S. PATENT DOCUMENTS

| | | | | |
|---|---|---|---|---|
| 7,410,282 | B2 * | 8/2008 | Eichelberger | F21S 48/1159 362/507 |
| 2005/0068787 | A1 * | 3/2005 | Ishida | B60Q 1/14 362/538 |
| 2005/0259431 | A1 * | 11/2005 | Iwasaki | F21S 48/1159 362/514 |
| 2006/0215415 | A1 * | 9/2006 | Suzuki | F21S 48/1159 362/539 |
| 2009/0097269 | A1 * | 4/2009 | Stauss | F21S 48/1159 362/539 |

(Continued)

FOREIGN PATENT DOCUMENTS

| | | |
|---|---|---|
| JP | 2006-351425 A | 12/2006 |
| JP | 2008-288113 A | 11/2008 |
| JP | 2010-161048 A | 7/2010 |

*Primary Examiner* — Bryon T Gyllstrom
(74) *Attorney, Agent, or Firm* — Foley & Lardner LLP

(57) ABSTRACT

A vehicle lamp comprises a reflector, a semiconductor light source, and a projection lens. The lens axis of the projection lens shifts upward relative to the center of a light emission surface. A reflection surface rotates upward about the center or near the center of the light emission surface. The light emission surface rotates upward to face the reflection surface about the center or near the center of the light emission surface. The rotation angle of the light emission surface is greater than the rotation angle of the reflection surface.

2 Claims, 5 Drawing Sheets

(56) References Cited

U.S. PATENT DOCUMENTS

| | | | | |
|---|---|---|---|---|
| 2009/0103323 | A1* | 4/2009 | Ishida | F21S 48/1159 362/538 |
| 2009/0231874 | A1* | 9/2009 | Kishimoto | B60Q 1/04 362/538 |
| 2009/0316423 | A1 | 12/2009 | Futami | |
| 2011/0032722 | A1* | 2/2011 | Ishida | F21S 48/1159 362/538 |
| 2011/0170306 | A1 | 7/2011 | Yatsuda et al. | |
| 2011/0205748 | A1 | 8/2011 | Yatsuda | |

* cited by examiner

VEHICLE LAMP

TECHNICAL FIELD

The present invention relates to a so-called projector-type vehicle lamp using a semiconductor-type light source as a light source.

BACKGROUND ART

A vehicle lamp of this type is conventional (for example, Patent Literatures 1, 2). The vehicle lamp of Patent Literature 1 includes a light source, a reflector having a spheroidal reflection surface, and a projection lens, in which a longitudinal axis of the reflector is arranged to be inclined rearward and downward from a second focal point, and the light source is arranged to be inclined downward toward the rear along a long axis of the inclined reflector. The vehicle lamp of Patent Literature 1 is configured such that a light source and a reflector are arranged to be inclined rearward, and light emitted from the light source reflects on the reflector with high efficiency, and enters a projection lens.

The vehicle lamp of Patent Literature 2 includes an LED light source, a spheroidal reflection surface, and a projection lens, in which a longitudinal axis of the reflection surface is arranged to be inclined downward toward the rear, and the LED light source is arranged downward toward the rear. The vehicle lamp of Patent Literature 2 can effectively use directional characteristics of the LED light source.

CITATION LIST

Patent Literatures

Patent Literature 1: JP-A-2006-351425
Patent Literature 2: JP-A-2008-288113

SUMMARY OF THE INVENTION

Problems to be Solved by the Invention

However, in the vehicle lamps of Patent Literatures 1, 2 the light source, the LED light source, the reflector and the reflection surface are arranged to be simply inclined rearward. Thus, the reflector and the reflection surface shift greatly to a lower side relative to the lens axis of the projection lens. Therefore, the vertical dimension may increase.

A problem to be solved by the present invention is that the vertical dimension may increase in a conventional vehicle lamp.

Means for Solving the Problem

The present invention as summarized as a vehicle lamp, comprising: a reflector having a basically elliptical reflection surface; a semiconductor-type light source in which a center of a light emission surface is located at a first focal point or near of the reflection surface; and a projection lens in which a lens focus is located at a second focal point or near of the reflection surface, wherein a lens axis of the projection lens is shifted upward or downward relative to a center of the light emission surface, the reflection surface is rotated upward or downward about a center or its vicinity of the light emission surface, the light emission surface is rotated upward or downward about a center or its vicinity of the light emission surface so as to face the reflection surface, and a rotation angle of the light emission surface is greater than a rotation angle of the reflection surface.

The present invention as summarized as a vehicle lamp, comprising: a reflector having a basically elliptical reflection surface; a semiconductor-type light source in which a center of a light emission surface is located at a first focal point or near of the reflection surface; and a projection lens in which a lens focus is located at a second focal point or near of the reflection surface, wherein the second focal point and the lens focus are located upward or downward than the first focal point, an optical axis of the reflection surface and a lens axis of the projection lens cross at the second focal point or the lens focus or in the vicinity thereof, the light emission surface and the optical axis cross at the first focal point or at a center or its vicinity of the light emission surface, and an angle formed by an extension line of the light emission surface and the lens axis is greater than an angle formed by the optical axis and the lens axis.

Effects of the Invention

In the vehicle lamp according to the present invention, the rotation angle of the light emission surface of the semiconductor-type light source is greater than the rotation angle of the reflection surface of the reflector. In other words, the angle formed by the extension line of the light emission surface of the semiconductor-type light source and the lens axis of the projection lens is greater than the angle formed by the optical axis of the reflection surface of the reflector and the lens axis of the projection lens. Thus, it is possible to reduce the angle of rotating the reflector, and possible to reduce the dimension that the reflection surface of the reflector shifts to the lower side or the upper side relative to the lens axis of the projection lens, as compared with the conventional vehicle lamp. As a result, it is possible to make the vertical dimension compact. Further, in the vehicle lamp of the present invention, it is possible to efficiently and effectively utilize the light from the semiconductor-type light source by increasing the angle of rotating the semiconductor-type light source to be greater than the angle of rotating the reflector, while reducing the angle of rotating the reflector.

MODES FOR CARRYING OUT THE INVENTION

Hereinafter, two exemplary embodiments of the vehicle lamp according to the present invention will be described in detail with reference to the drawings. The invention is not limited to the embodiments. In this specification and attached claims, front, back, top, bottom, left, right are front, back, top, bottom, left, right when a vehicle lamp according to the present invention is mounted on a vehicle.

Description of Configuration of Embodiment 1

Figure 1:
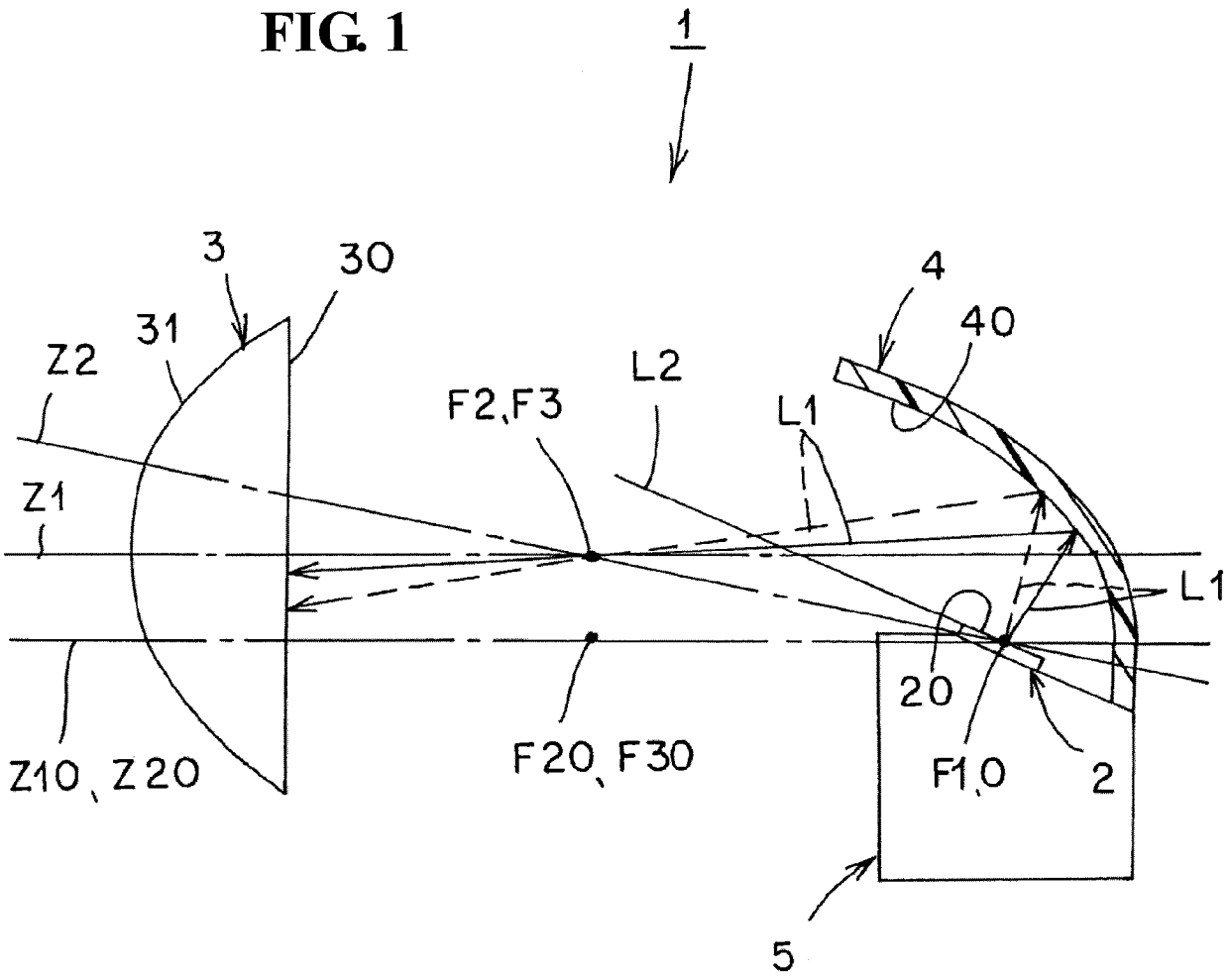
FIG. 1 is a partial schematic longitudinal sectional view (partial schematic vertical sectional view) showing an embodiment 1 of the vehicle lamp according to the present invention.
Figure 2:
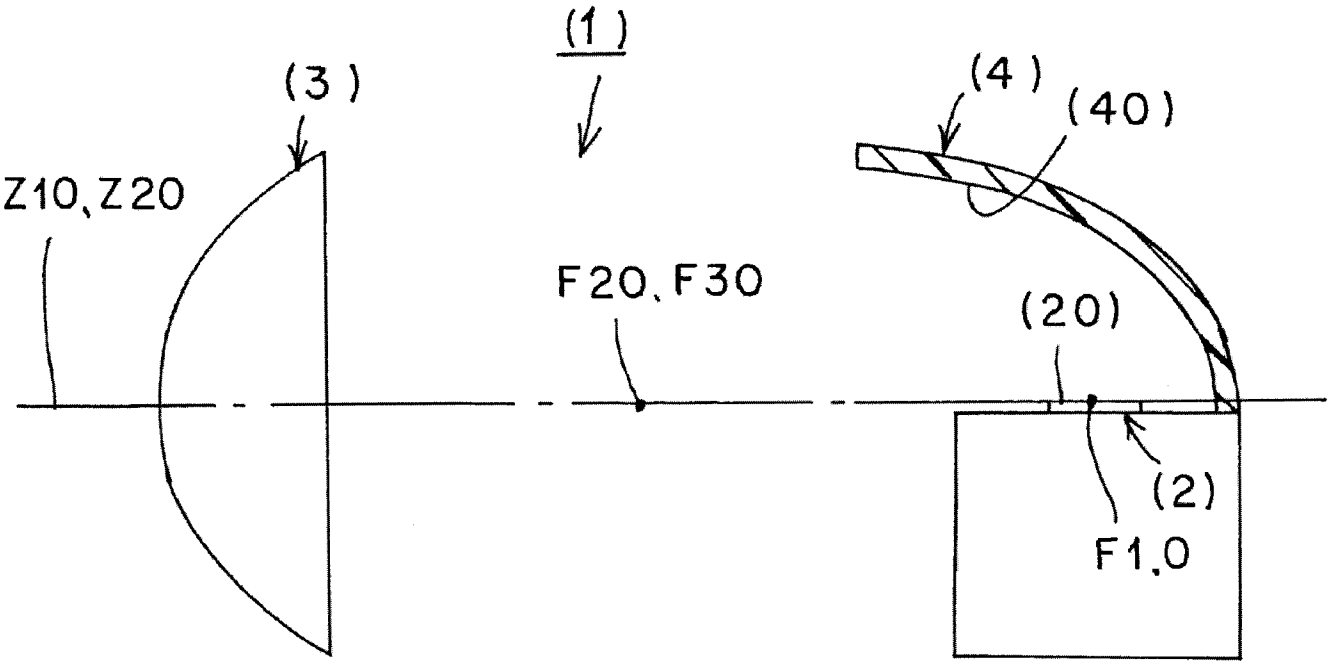
FIG. 2 shows explanatory diagrams showing a relative relationship between a reflector, a semiconductor-type light source, and a projection lens.
Figure 2:
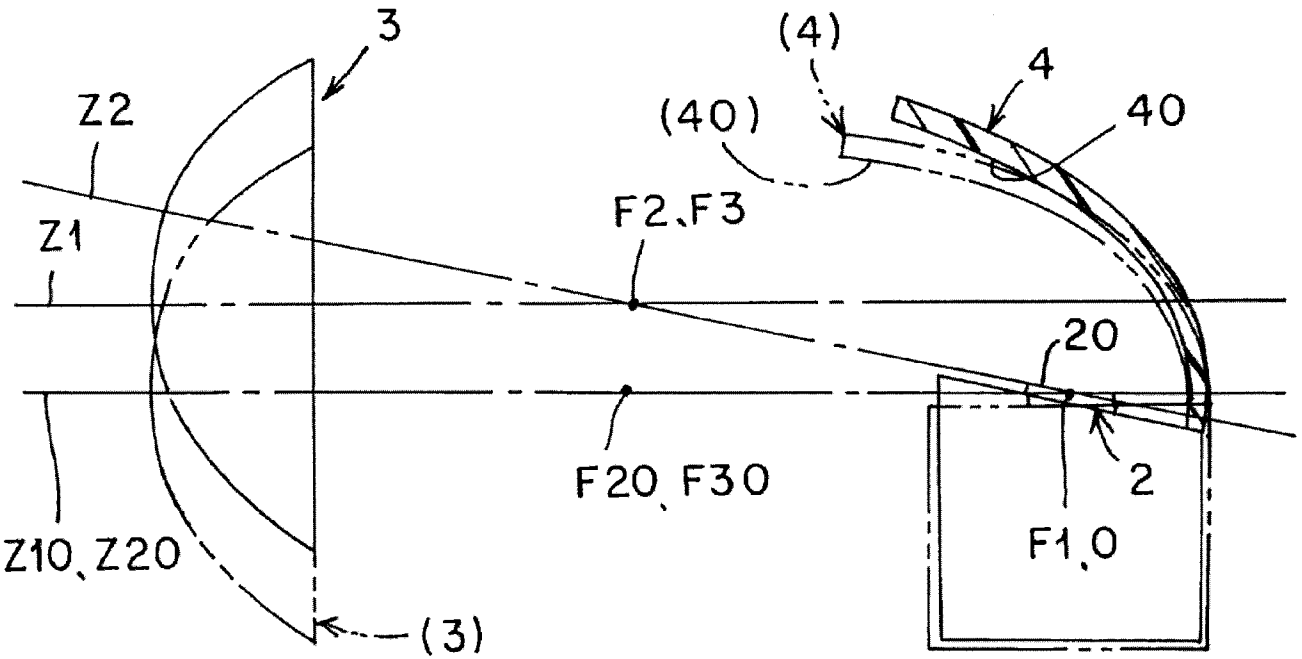
Figure 2:
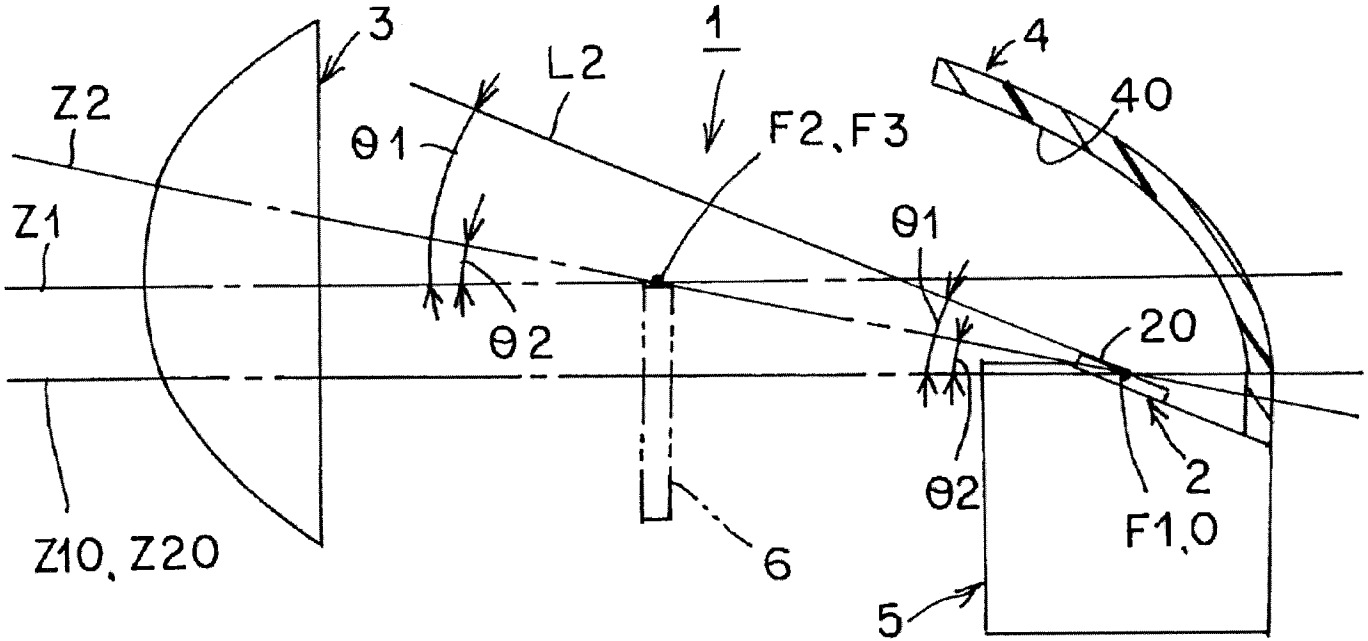

FIGS. 1 and 2 show an embodiment 1 of the vehicle lamp according to the present invention. Hereinafter, a configuration of the vehicle lamp of the embodiment 1 will be described. In this embodiment, for example, a headlamp of a vehicle headlight will be described.

Description of Vehicle Lamp 1

In FIG. 1, a reference numeral 1 denotes a vehicle lamp according to the embodiment 1. The vehicle lamp 1 is mounted on the left and right ends of the front of a vehicle. The vehicle lamp 1 comprises, as shown in FIG. 1, a lamp housing (not shown), a lamp lens (not shown), a semiconductor-type light source 2, a projection lens 3, a reflector 4, and a heat sink member 5.

The lamp housing and the lamp lens (e.g., a plain outer lens) define a lamp chamber (not shown). The semiconductor-type light source 2, the projection lens 3, the reflector 4, and the heat sink member 5 configure a projector-type lamp unit. The lamp units 2, 3, 4, 5 are arranged in the lamp chamber, and attached to the lamp housing via a vertical direction optical axis adjustment mechanism (not shown) and a horizontal direction optical axis adjustment mechanism (not shown).

The light emission surface 20 of the semiconductor-type light source 2 is faced upward. The reflector 4 is arranged on the upper side relative to the semiconductor-type light source 2. The semiconductor-type light source 2 and the reflector 4 are arranged on the rear side relative to the projection lens 3.

Description of Heat Sink Member 5

The heat sink member 5 is made of a material having high thermal conductivity, such as resin or metal die cast (aluminum die cast). The heat sink member 5 comprises a plate-shaped mounting portion, and a fin-shaped heat radiating portion. The heat sink member 5 is also used as a mounting member for mounting the semiconductor-type light source 2, the projection lens 3, and the reflector 4.

Description of Reflector 4

The reflector 4 is made of a material with high thermal conductivity and light-impermeability, such as resin or metal die cast (aluminum the cast). The reflector 4 is attached to the heat sink member 5. The reflector 4 is formed in a hollow shape in which front and lower portions are opened, and rear and upper portions and right and left side portions are closed. In the concave inner surface of the closed portion of the reflector 4, a reflection surface (convergent reflection surface) 40 comprising a free-form surface based on a spheroidal (elliptical) surface is provided. The reflection surface 40 is configured to reflect light L1 from the semiconductor-type light source 2 toward the projection lens 3 as reflected light (L1). The reflection surface 40 may be a reflection surface comprising a simple spheroidal surface.

The reflection surface 40 comprises a free-form surface. Thus, the reflection surface 40 does not have a single focus, in strict sense, in a first focal point F1 and second focal point (or second focal line) F2, but shares substantially the same focal point, because a difference in the focal length of the plurality of reflection surfaces is small. In this specification and drawings, a focal point is simply referred to as a first focal point or a second focal point.

The reflection surface 40 has an optical axis Z2 that connects the first focal point F1 and the second foal point F2. In the optical axis Z2 of the reflection surface 40, the reflection surface 40 does not have a single optical axis, in strict sense, but shares substantially the same optical axis, because a difference in the optical axis of the plurality of reflection surfaces is small. In this specification and drawings, the optical axis is simply referred to as an optical axis.

The second focal point F2 is located above the first focal point F1. In other words, the reflection surface 40 is formed by rotationally moving the second focal point F2 of the projection lens 3 upward about the center or near the center of the first focal point F1 of the semiconductor-type light source 2. As a result, in the optical axis Z2 of the reflection surface 40, the front side is inclined upward, and the rear side is inclined downward.

An optical axis Z20 of a reflection surface in an ordinary projector-type lamp unit (hereinafter referred to as an "ordinary vehicle lamp (1)") is, as shown in FIG. 2 (A), horizontal. In other words, the second focal point F20 in the ordinary vehicle lamp (1) is located on a horizontal line of the same height as the first focal point F1, and the optical axis Z20 is horizontal.

Description of Semiconductor-Type Light Source 2

The semiconductor-type light source 2 is a self-emitting semiconductor-type light source, such as an LED, OEL, or OLED (organic EL). The semiconductor-type light source 2 has the light emission surface 20 for radiating the light L1. The semiconductor-type light source 2 is attached to the heat sink member 5. The center O of the light emitting surface 20 of the semiconductor-type light source 2 is located at or near the first focal point F1 of the reflection surface 40 of the reflector 4.

The light emission surface 20 of the semiconductor-type light source 2 is faced upward, and opposite to the reflection surface 40 of the reflector 4. In the light emission surface 20 of the semiconductor-type light source 2, the front side is inclined upward, and the rear side is inclined downward about the center O or near of the the light emission surface 20.

Description of Projection Lens 3

The projection lens 3 comprises a resin lens made of PC material, PMMA material, or PCO material. In other words, the light L1 emitted from the semiconductor-type light source 2 does not have high heat, and the projection lens 3 may be a resin lens. The projection lens 3 is attached to the heat sink member 5 via a holder (not shown).

The projection lens 3 radiates a predetermined main light distribution pattern, for example, a high beam light distribution pattern (not shown), that is the light L1 from the semiconductor-type light source 2, to the outside, that is, the forward of a vehicle. The projection lens 3 is a basically aspherical projection lens. The projection lens 3 is configured with a rear incident surface 30 and a front exit surface 31. The incident surface 30 faces the reflection surface 40 of the reflector 4. The incident surface 30 is formed plain or substantially plain aspherical (convex or concave with respect to the reflection surface 40). The exit surface 31 forms a convex aspherical surface.

A lens focus F3 of the projection lens 3 (Meridional image plane that is a focal plane of object space side) coincides or nearly coincides with the second focal point F2 of the reflection surface 40. Thus, the lens focus F3 is located above the first focal point F1. As a result, the projection lens 3 moves upward in accordance with the amount of upward rotational movement of the second focal point F2 of the reflection surface 40. In other words, the lens axis Z1 of the projection lens 3 moves upward in accordance with the amount of upward rotational movement of the second focal point F2 of the reflection surface 40. Thus, the optical axis Z2 and the lens axis Z1 cross at the second focal point F2 or at the lens focus F3 or in the vicinity thereof.

Here, the light L1 emitted from the light emission surface 20 of the semiconductor-type light source 2, that is, the light passing through or near the lens axis Z1 of the projection lens 3 (see the solid arrow in FIG. 1), out of the reflected light L1 on the reflection surface 40 of the reflector 4, is emitted mainly to a central portion of a high beam light distribution pattern.

A lens axis Z10 in an ordinary vehicle lamp (1) coincides or nearly coincides with the optical axis Z20 as shown in FIG. 2 (A). In other words, the first focal point F1, the second focal point F20, and the lens focus F30 in the ordinary vehicle lamp (1) are located on the same height horizontal line, and the lens axis Z10 is horizontal like the optical axis Z20, and coincides or nearly coincides with the optical axis Z20.

Description of Relationship Between Reflector 4, Semiconductor-Type Light Source 2, and Projection Lens 3

Hereinafter, the relationship between the reflector 4, the semiconductor-type light source 2, and the projection lens 3 will be described with reference to FIGS. 2 (A), (B), (C). In the vehicle lamp (1) in FIG. 2 (A), (B), the same parts as those of the vehicle lamp 1 are denoted by the same reference numerals put in ( ).

First, as shown in FIG. 2 (A), the optical axis Z20 of the reflection surface (40) of the ordinary vehicle lamp (1) is horizontal. In other words, the second focal point F20 of the ordinary vehicle lamp (1) is located on the same height horizontal line, and the optical axis Z20 is horizontal. Further, the lens axis Z10 of the ordinary vehicle lamp (1) coincides or nearly coincides with the optical axis Z20. In other words, as the first local point F1 and the second focal point F20 and the lens focus F30 of the ordinary vehicle lamp (1) are located on the same height horizontal line, the lens axis Z10 is horizontal like the optical axis Z20, and coincides or nearly coincides with the optical axis Z20.

On the other hand, as shown in FIG. 2 (B), the lens axis Z1 of the projection lens 3 of the vehicle lamp 1 is shifted upward relative to the center O of the light emission surface 20. In other words, as indicated by a solid line in FIG. 2 (B), the projection lens 3 of the vehicle lamp 1 is shifted upward relative to the center O of the light emission surface 20, with respect to the projection lens (3) of the ordinary vehicle lamp (1) (see the two-dot chain line in FIG. 2 (B)). Here, the shift distance between the lens axis Z1 of the projection lens 3 and the center O of the light emission surface 20 is about 5 mm in this example.

Further, as indicated by the solid line in FIG. 2 (B), the reflection surface 40 of the reflector 4 of the vehicle lamp 1 is rotated upward about the center O or its vicinity of the light emission surface 20, with respect to the reflection surface (40) (see the two-dot chain line in FIG. 2 (B)) of the reflector 4 of the ordinary vehicle lamp (1).

Furthermore, as shown in FIG. 2 (A), (B), the light emission surface 20 of the semiconductor-type light source 2 of the vehicle lamp 1 is rotated upward or downward (the front side is rotated upward, and the rear side is rotated downward) about the center O or its vicinity of the light emission surface 20 relative to the light emission surface (20) of the semiconductor-type light source (2) of the ordinary vehicle lamp (1), so as to face the reflection surface 40.

And, as shown in FIGS. 1, 2 (C), the rotation angle θ1 (about 25° in this example) of the light emission surface 20 of the semiconductor-type light source 2 is greater than the rotation angle θ2 (about 15° in this example) of the reflection surface 40 of the reflector 4. In other words, the angle θ1 formed by the lens axis Z10 and optical axis Z20 and the extension line L2 of the light emission surface 20 of the ordinary vehicle lamp (1) is greater than the angle θ2 formed by the lens axis Z10 and optical axis Z20 and the optical axis Z2 of the reflection surface 40 of the ordinary vehicle lamp (1).

In other words, as shown in FIGS. 1, 2 (B), the second focal point F2 of the reflection surface 40 of the reflector 4 and the lens focus F3 of the projection lens 3 are located above the first focal point F1 of the reflection surface 40 of the reflector 4. The optical axis Z2 of the reflection surface 40 of the reflector 4 and the lens axis Z1 of the projection lens 3 cross at the second focal point F2 of the reflection surface 40 of the reflector 4 or the lens focus F3 of the projection lens 3 or in the vicinity thereof. Further, the light emission surface 20 of the semiconductor-type light source 2 and the optical axis Z2 of the reflection surface 40 of the reflector 4 cross at the first focal point F1 of the reflection surface 40 of the reflector 4 or at the center O or its vicinity of the light emission surface 20 of the semiconductor-type light source 2. Further, as shown in FIGS. 1, 2 (C), the lens axis Z1 of the vehicle lamp 1 is parallel to the lens axis Z10 of the ordinary vehicle lamp (1). Thus, the angle θ1 formed by the extension line L2 of the light emission surface 20 of the semiconductor-type light source 2 and the lens axis Z1 of the projection lens 3 is greater than the angle η2 formed by the optical axis Z2 of the reflection surface 40 of the reflector 4 and the lens axis Z1 of the projection lens 3.

Description of Functions of the Embodiment 1

The vehicle lamp 1 according to the embodiment 1 has the above configuration. Hereinafter, the functions of the embodiment will be described.

When the semiconductor-type light source 2 is turned on, the light L1 emitted from the light emission surface 20 of the semiconductor-type light source 2 reflects on the reflection surface 40 of the reflector 4, and enters the projection lens 3. The reflected light L1 passes through the projection lens 3, and is emitted to the outside, that is, forward of a vehicle, as a predetermined light distribution pattern, a high beam light distribution pattern in this example.

At this time, out of the light L1 emitted from the light emission surface 20 of the semiconductor-type light source 2, the light that is vertical or nearly vertical to the center O of the light emission surface 20 of the semiconductor-type light source 2 (see the solid arrow in FIG. 1) is strong (or high in brightness, illumination, light intensity) as compared with the other light (see the dashed arrow in FIG. 1). The strong light passes through the lens axis Z1 or near of the projection lens 3. Thus, it is suitable for forming a high luminous intensity zone (hot zone) of a central part of a high beam light distribution pattern.

The heat generated in the semiconductor-type light source 2 is radiated to the outside via the heat sink member 5.

Description of Effects of the Embodiment 1

The vehicle lamp 1 according to the embodiment 1 has the above configuration and functions. Hereinafter, the effects of the embodiment will be described.

In the vehicle lamp 1 according to the embodiment 1, as shown in FIG. 2 (C), the rotation angle θ1 of the light emission surface 20 of the semiconductor-type light source 2 is greater than the rotation angle θ2 of the reflection surface 40 of the reflector 4. In other words, the angle θ1 formed by the extension line L2 of the light emission surface 20 of the semiconductor-type light source 2 and the lens axis Z1 of the projection lens 3 is greater than the angle θ2 formed by the optical axis Z2 of the reflection surface 40 of the reflector 4 and the lens axis Z1 of the projection lens 3. Thus, the angle θ2 of rotating the reflector 4 can be reduced, and it is possible to reduce the dimension that the reflection surface 40 of the reflector 4 shifts to the lower side relative to the lens axis Z1 of the projection lens 3, as compared with the conventional vehicle lamp. As a result, it is possible to reduce the vertical dimension.

Further, in the vehicle lamp 1 according to the embodiment 1, it is possible to efficiently and effectively utilize the light L1 from the semiconductor-type light source 2, by increasing the angle θ1 of rotating the semiconductor-type light source 2 to be greater than the rotation angle θ2 of the reflector 4, thereby it is possible to make the vertical dimension compact, while reducing the angle η2 of rotating the reflector 4. In other words, out of the light L1 emitted from the light emission surface 20 of the semiconductor-type light source 2, the light that is vertical or nearly vertical to the center O of the light emission surface 20 of the semiconductor-type light source 2 (see the solid arrow in FIG. 1) is strong (or high in brightness, illumination, light intensity) as compared with the other light (see the dashed arrow in FIG. 1). The strong light passes through or near the lens axis Z1 of the projection lens 3. Thus, it is suitable for forming a high luminous intensity zone (hot zone) of a central part of a high beam light distribution pattern.

Description of Configuration, Functions, and Effects of the Embodiment 2

Figure 3:
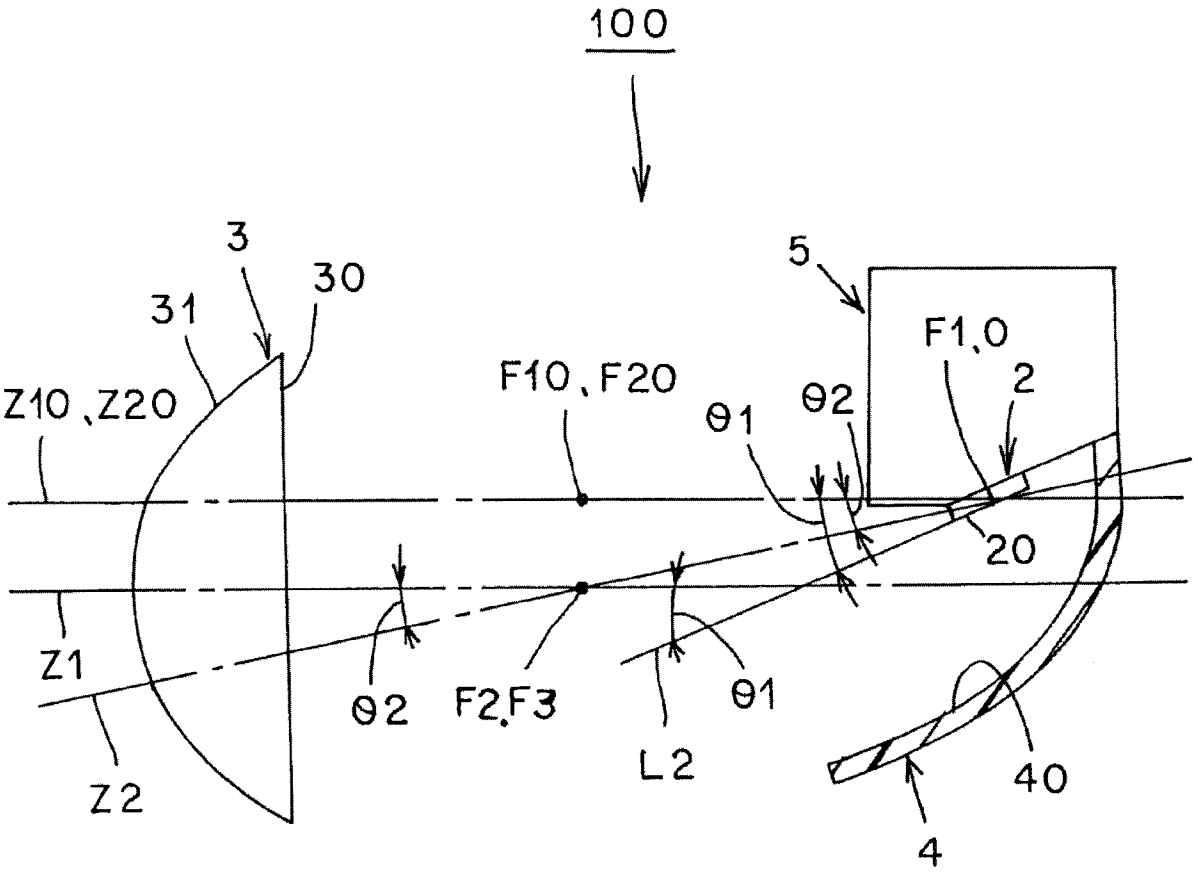
FIG. 3 is a partial schematic longitudinal sectional view (partial schematic vertical sectional view) showing an embodiment 2 of the vehicle lamp according to the present invention.

FIG. 3 shows an embodiment 2 of the vehicle lamp according to the present invention. In the drawings, the same reference numerals as those in FIGS. 1 and 2 denote the same parts. Hereinafter, a vehicle lamp 100 according to the embodiment 2 will be described.

In the vehicle lamp 1 according to the embodiment 1, the light emission surface 20 of the semiconductor-type light source 2 is faced upward. The reflector 4 is arranged on the upper side relative to the semiconductor-type light source 2. On the other hand, in a vehicle lamp 100 according to the embodiment 2, the light emission surface 20 of the semiconductor-type light source 2 is faced downward. The reflector 4 is arranged on the lower side relative to the semiconductor-type light source 2.

In the vehicle lamp 100 according to the embodiment 2, the lens axis Z1 of the projection lens 3 is shifted downward relative to the center O of the light emission surface 20, the reflection surface 40 is rotated downward about the center O or its vicinity of the light emission surface 20, the light emission surface 20 is rotated downward about the center O or its vicinity of the light emission surface 20 so as to face the reflection surface 40, and the rotation angle θ1 of the light emission surface 20 is greater than the rotation angle θ2 of the reflection surface 40.

In other words, in the vehicle lamp 100 according to the embodiment 2, the second focal point F2 and the lens focus F3 are located below the first focal point F1, the optical axis Z2 of the reflection surface 40 and the lens axis Z1 of the projection lens 3 cross at the second focal point F2 or the lens focus F3 or in the vicinity thereof, the light emission surface 20 and the optical axis Z2 cross at the first focal point F1 or at the center O or its vicinity of the light emission surface 20, and the angle θ1 formed by the extension line L2 of the light emission surface 20 and the lens axis Z1 is greater than the angle θ2 formed by the optical axis Z2 and the lens axis Z1.

The vehicle lamp 100 according to the embodiment 2 has the above configuration. Thus, it is possible to achieve almost the same effects as the vehicle lamp 1 of the embodiment 1.

Description of Examples Other than the Embodiments 1, 2

In the embodiments 1, 2, a headlamp for radiating a high beam light distribution pattern has been described. However, in the present invention, a vehicle lamp may radiate a light distribution pattern other than a high beam light distribution patter, for example, a low beam light distribution pattern. In this case, as shown by the two-dot chain line in FIG. 2 (C), a shade 6 is placed between the semiconductor-type light source 2 and the reflector 4 and the projection lens 3, and an upper edge of the shade 6 is placed at the second focal point F2 or the lens focus F3 or in the vicinity thereof. Here, an additional reflection surface (not shown) may be provided in the shade 6, and an additional light distribution pattern may be added to a low beam light distribution pattern.

DESCRIPTION OF REFERENCE NUMERALS

1, 100 Vehicle lamp
2 Semiconductor-type light source
20 Light emission surface
3 Projection lens
30 Incident surface
31 Exit surface
4 Reflector
40 Reflection surface
5 Heat sink member
6 Shade
F1 First focal point
F2, F20 Second focal point
F3, F30 Lens focus
L1 Light
L2 Extension line
O Center
Z1, Z10 Lens axis
Z2, Z20 Optical axis

The invention claimed is:

1. A vehicle lamp, comprising:

a reflector having a basically elliptical reflection surface;

a semiconductor-type light source in which a center of a light emission surface is located at or near to a first focal point of the reflection surface; and a projection lens in which a lens focus is located at or near to a second focal point of the reflection surface, wherein a lens axis of the projection lens is shifted upward or downward relative to the center of the light emission surface, the reflection surface is rotated upward or downward about the center or its vicinity of the light emission surface, the light emission surface is rotated upward or downward about the center or its vicinity of the light emission surface so as to face the reflection surface, and a first angle between a line parallel to the rotated light emission surface and the lens axis is greater than a second angle between an optical axis of the rotated reflection surface and the lens axis.

2. A vehicle lamp, comprising: a reflector having a basically elliptical reflection surface;

a semiconductor-type light source in which a center of a light emission surface is located at or near to a first focal point of the reflection surface; and a projection lens in which a lens focus is located at or near to a second focal point of the reflection surface, wherein the second focal point and the lens focus are located upward or downward relative to the first focal point, an optical axis of the reflection surface and a lens axis of the projection lens cross at the second focal point or the lens focus or in the vicinity thereof, the light emission surface and the optical axis cross at the first focal point or at the center or its vicinity of the light emission surface, and an angle formed by an extension line of the light emission surface and the lens axis is greater than an angle formed by the optical axis and the lens axis, the extension line being parallel to the light emission surface.

* * * * *